US005456455A

United States Patent [19]

Dillehay et al.

[11] Patent Number: 5,456,455

[45] Date of Patent: Oct. 10, 1995

[54] FLARE PELLET AND PROCESS FOR MAKING SAME

[75] Inventors: David R. Dillehay; David W. Turner, both of Marshall, Tex.

[73] Assignee: Thiokol Corporation, Ogden, Utah

[21] Appl. No.: 189,803

[22] Filed: Feb. 1, 1994

[51] Int. Cl.[6] ..... C06B 21/00

[52] U.S. Cl. ..... 264/3.1; 264/3.4; 102/346; 86/20.12

[58] Field of Search ..... 264/3.1, 3.4; 86/20.12; 102/336, 346, 292

[56] References Cited

U.S. PATENT DOCUMENTS

| | | | |
|---|---|---|---|
| 751,385 | 2/1904 | Davis . | |
| 3,664,133 | 5/1972 | Iwanciow et al. | 60/255 |
| 3,724,375 | 4/1973 | Calkins et al. | 102/31 |
| 3,754,060 | 8/1973 | Gawlick et al. | 264/3.4 |
| 3,807,171 | 4/1974 | Anderson | 60/255 |
| 3,931,374 | 1/1976 | Moutet | 264/3.4 |
| 3,938,444 | 2/1976 | Foote et al. | 102/99 |
| 4,498,392 | 2/1985 | Billard et al. | 102/342 |
| 4,619,201 | 10/1986 | Romer et al. | 102/292 X |
| 4,621,579 | 11/1986 | Badura et al. | 102/334 |
| 4,624,186 | 11/1986 | Widera et al. | 102/336 |
| 4,695,414 | 9/1987 | Forslund et al. | 264/3.1 |
| 4,710,329 | 12/1987 | Lebas et al. | 264/3.1 |
| 4,793,955 | 12/1988 | Poulter et al. | 264/3.3 |
| 4,838,167 | 6/1989 | Prahauser et al. | 102/334 |
| 5,034,070 | 7/1991 | Goetz et al. | 149/3 |
| 5,074,216 | 12/1991 | Dunne et al. | 102/334 |
| 5,074,938 | 12/1991 | Chi | 102/292 |
| 5,136,950 | 8/1992 | Halpin et al. | 102/336 |
| 5,377,593 | 1/1995 | Boothe et al. | 102/289 |

*Primary Examiner*—Peter A. Nelson

*Attorney, Agent, or Firm*—Madson & Metcalf; Ronald L. Lyons

[57] ABSTRACT

A process forms decoy flare pellets which satisfy predetermined burn requirements without milling additional grooves into the pellet flare material after that material is consolidated. The process includes providing sufficient surface area to the flare material during consolidation to eliminate the need for milling. Consolidated flare pellets are then coated with an ignition composition and installed in a decoy flare housing.

8 Claims, 7 Drawing Sheets

FLARE PELLET AND PROCESS FOR MAKING SAME

FIELD OF THE INVENTION

The present invention relates to pellets used in decoy flares and to a process for making such pellets. More particularly, the present invention relates to flare pellets which are produced without the need for expensive and wasteful groove cutting.

TECHNICAL BACKGROUND OF THE INVENTION

Decoy flares are used defensively by combat aircraft to evade heat-seeking missiles directed at such aircraft by an enemy. At an appropriate time after the enemy launches a heat-seeking missile, the targeted aircraft releases a decoy flare. The decoy flare burns in a manner that simulates the engines of the targeted aircraft. Ideally, the missile locks onto and destroys the decoy, permitting the targeted aircraft to escape unharmed.

The burn requirements of the decoy flare are therefore determined by reference to the known characteristics of the targeted aircraft's engine emissions as interpreted by the heat-seeking missile. It is necessary for the decoy to burn at a temperature and for a duration that will induce the missile to lock onto the decoy instead of the escaping friendly aircraft. It may also be necessary for the decoy to emit certain wavelengths while burning, as some missiles examine a potential target's energy spectrum in order to distinguish decoys from targeted aircraft by the presence of wavelength signatures.

A central goal in the decoy flare art is to produce satisfactory decoy flares in an efficient and cost-effective manner. It is generally sufficient for the decoy to cause the missile to lock on to and destroy the decoy. Because a missile destroys each successful decoy, producing decoys that substantially exceed the burn requirements is not an important goal. A decoy that far exceeds the burn requirements will be destroyed just as promptly as one that barely satisfies the burn requirements. The goal of producing effective flares in turn requires efficient and cost-effective production of flare pellets.

Each decoy flare contains a flare pellet which is ignited when the decoy is deployed. The burning flare pellet produces the heat and other emissions needed to satisfy the decoy's burn requirements and thus permit the missile to lock onto the decoy. The flare pellet includes a shaped quantity of flare material which is coated with an ignition composition.

The flare material is shaped by a process which includes consolidation under pressure, followed by milling. In the first step, the flare material is consolidated by being compressed in a mold. Typical flare materials contain synthetic resin polymers such as polytetrafluoroethylene. During consolidation, these synthetic resin polymers tend to flow and form a solid matrix with other components of the flare material.

Conventional flare molds include two die faces which engage one another along an outer edge to form an enclosed space. The enclosed space generally defines a grooved six-sided rectangular solid. The flare material is compressed and consolidated within this enclosed space by pressure from the die faces.

The die faces are shaped to impress grooves into two opposite sides of the consolidated flare material. Grooves may also be impressed by the dies into the ends of the pellet. Grooves increase the surface area of the flare pellet relative to its volume, thereby assisting the pellet in meeting the burn requirements. In some instances, grooves are also impressed into the remaining two sides of the pellet. However, the dies and equipment needed to impress grooves into all six sides of the pellet are often prohibitively complex and expensive.

When grooves are impressed only into two sides of the pellet, the surface area of the pellet is typically insufficient to satisfy the burn requirements, and the addition of grooves by other means is required. Moreover, it has been thought that performance of the pellet may be unsatisfactory unless grooves are placed symmetrically in all four sides of the pellet. Thus, additional grooves are generally cut into the two groove-free sides of the pellet by a milling step after consolidation. After milling, all four sides and both ends of the pellet contain grooves that increase the pellet's surface area. The milled pellet is then coated with an ignition composition and installed in a decoy flare housing.

This milling step is expensive for several reasons. The milling process requires special cutter equipment and a worker to operate the cutters. The cutters require regular maintenance and/or repair. Maintenance and repair are needed to ensure the accuracy of the cut, to permit clean cuts, and to avoid injuries to cutter operators.

Milling also increases the amount of flare material used per pellet. The material removed from a consolidated pellet by milling cannot be reused. The formation of a solid matrix between the flowing synthetic resin polymers and the other flare material components cannot be reformed by subsequent consolidations. Thus, the removed material must be collected and moved to another area for proper disposal. In an existing operation, approximately fifteen percent of every batch of flare mix is cut out by milling instead of being used in pellets. Moreover, the costs of disposing of the milled material in an environmentally acceptable manner are significant.

Thus, it would be an advancement in the art to provide a process for making flare pellets which eliminates the need for milling after consolidation but nonetheless provides pellets that satisfy the predetermined burn requirements.

Such a process and flares are disclosed and claimed herein.

BRIEF SUMMARY OF THE INVENTION

The present invention provides a consolidation molding process for forming flare material into a flare pellet with a surface area sufficient to satisfy predetermined burn requirements such as ignition temperature, burn rate, output wavelength and intensity, and total burn time. The present consolidation molding process eliminates the need to mill additional grooves into the pellet before coating the consolidated material with an ignition composition. The present invention also eliminates the use of complex and expensive dies which impress grooves on all four sides and both ends of the pellet during consolidation.

In producing a flare pellet according to the teachings of the present invention, a predetermined quantity of unconsolidated flare material is placed adjacent a first die face. A matching second die face is then brought into engagement with the first die face, thereby compressing the flare material between the two dies. The dies are shaped to impress sufficient grooves into the two opposite sides of the pellet to satisfy the pellet's burn requirements without subsequent milling. Thus, two sides of the consolidated pellet remain substantially free of grooves up to and through the time when the pellet is coated with an ignition composition. The performance of pellets produced according to the present invention is satisfactory even though grooves are placed asymmetrically about the pellet.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only illustrate selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
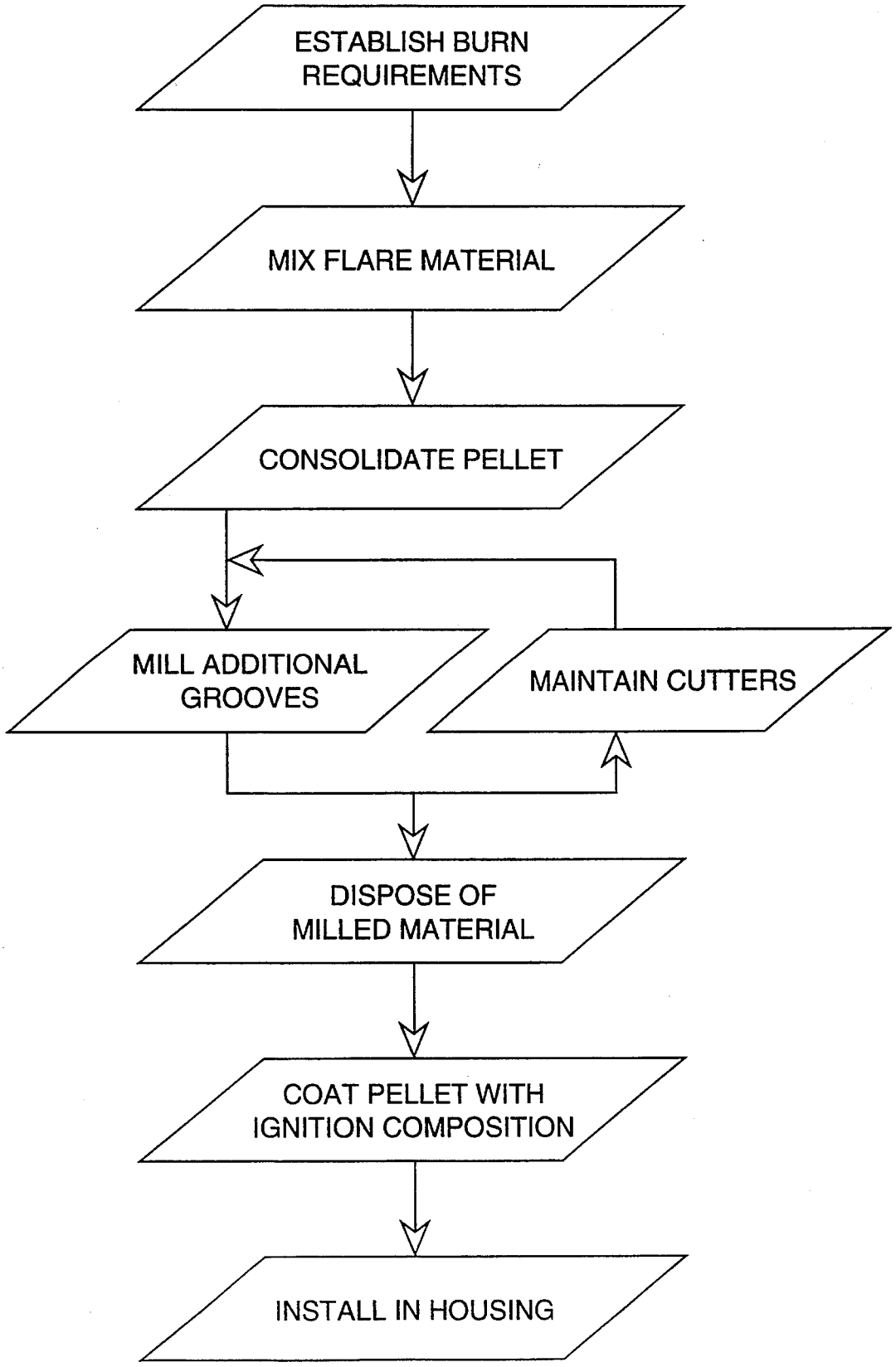
FIG. 1 is a flow diagram illustrating several steps used in conventional processes for producing decoy flare pellets, which includes the step of milling grooves into the pellet after consolidation.

Reference is now made to the figures wherein like parts are referred to by like numerals. The present invention relates to a process for forming flare material into a flare pellet with a surface area sufficient to satisfy predetermined burn requirements. FIG. 1 illustrates the steps employed in producing flare pellets without the benefit of the present invention.

The conventional process of FIG. 1 begins by establishing the burn requirements a flare decoy must satisfy. The burn requirements are determined by means well known in the art. For instance, the requirements may be set forth in specifications provided to the decoy flare manufacturer. The burn requirements depend on characteristics of the targeted aircraft's engine emissions as interpreted by the heat-seeking missile. In general, the decoy must burn at an intensity and for a duration that will induce an enemy missile to lock onto the decoy instead of the targeted friendly aircraft. The burn requirements may also specify that the decoy flare's emissions produce particular wavelength signatures.

The burn requirements are determined by the total action time (i.e., time above the decoying threshold) for the threat. An envelope is established, indicated by the straight line shape 40 under the curves 38, 42 in FIGS. 6 and 7, that the decoy must exceed to allow the aircraft to leave the attacking missile's field of view. After the flare is consumed, the missile will seek to reacquire the target but should fail because the lock on the flare permits the aircraft to separate from the vicinity.

Once the burn requirements are determined, a flare material having the required chemical properties is mixed. Suitable chemical compositions are well known in the art, both for use as an ignition composition and for use in the underlying flare material. Exemplary flare compositions that have been tested include, but are not limited to, magnesium and polytetrafluoroethylene with a synthetic resin polymer capable of forming a solid matrix with the other flare material components during consolidation. Other flare compositions are similarly adapted to this application. However, the present invention assumes that the composition used will regress generally perpendicularly to the flare pellet surface, and that the surface area will change in a predictable manner. The output in infrared flares is generally a function of the surface area burning, but this is not necessarily true of all illuminants useful according to the teachings herein.

Figure 2:
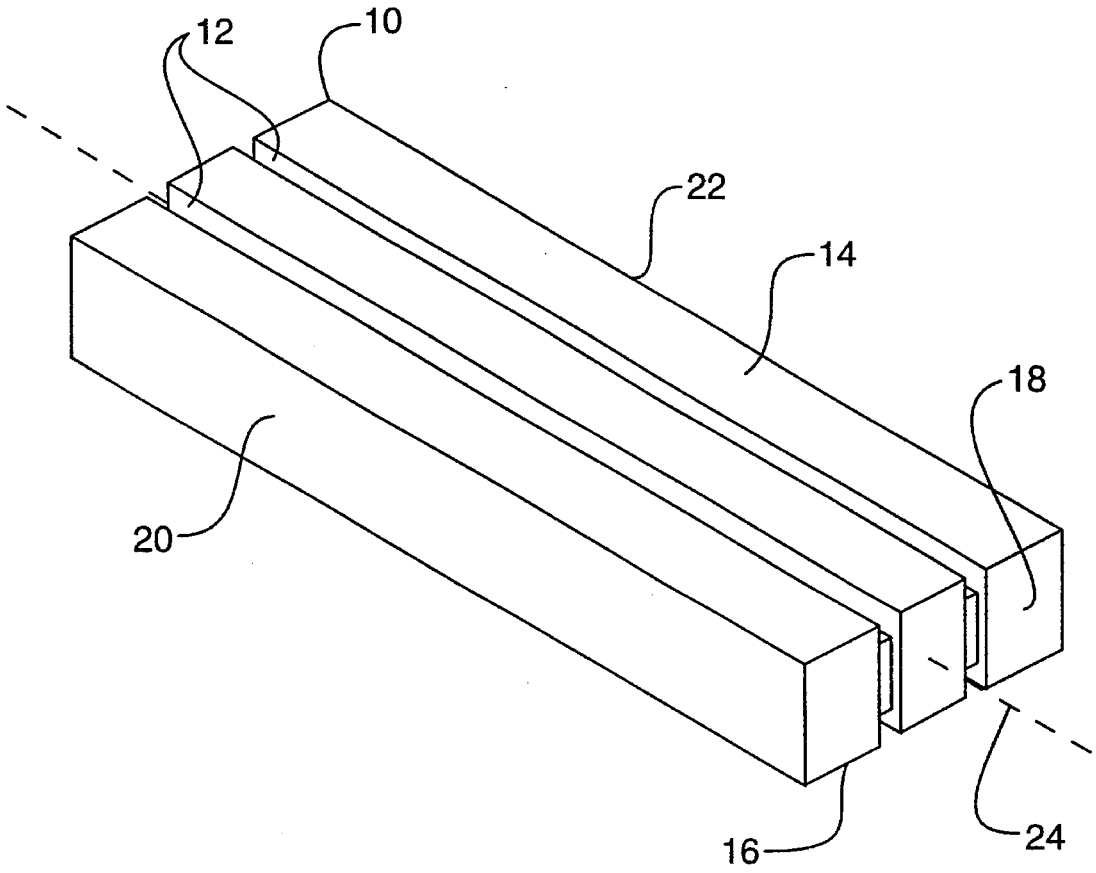
FIG. 2 is a perspective view of a symmetric pellet produced by the conventional process in FIG. 1, showing the grooves produced by consolidation prior to milling of the pellet.

During consolidation, grooves are impressed into the pellet. As explained below, consolidation under the conventional approach differs in important ways from the consolidation step of the present invention. Under the conventional process of FIG. 1, consolidation produces a pellet resembling the pellet 10 shown in FIG. 2. The pellet 10 contains grooves 12 on the upper side 14, the lower side 16, and an end 18 of the pellet 10. There are no grooves on the left side 20 or the right side 22 of the pellet 10. The surface area of the pellet 10 shown in FIG. 2 is not sufficient to satisfy the burn requirements because additional grooves are required on sides 20 and 22. These grooves are provided during a subsequent milling step. Also, it has been thought that the grooves 12 should be placed generally symmetrically about the central longitudinal axis 24 of the pellet 10. Thus, additional grooves 26 are milled into the sides 20 and 22 of the pellet 10, resulting in the pellet configuration illustrated in FIG. 3.

As set forth in FIG. 1, the step of milling additional grooves in turn makes other steps necessary. For instance, the cutting equipment must be maintained and sometimes repaired. Moreover, the milled material must be disposed of properly. Disposal involves relocating the milled material to an appropriate waste facility. Additional costs are associated with purchasing the cutting equipment, locating the cutting equipment in a suitable facility, and hiring and training workers to operate the cutting equipment.

Figure 3:
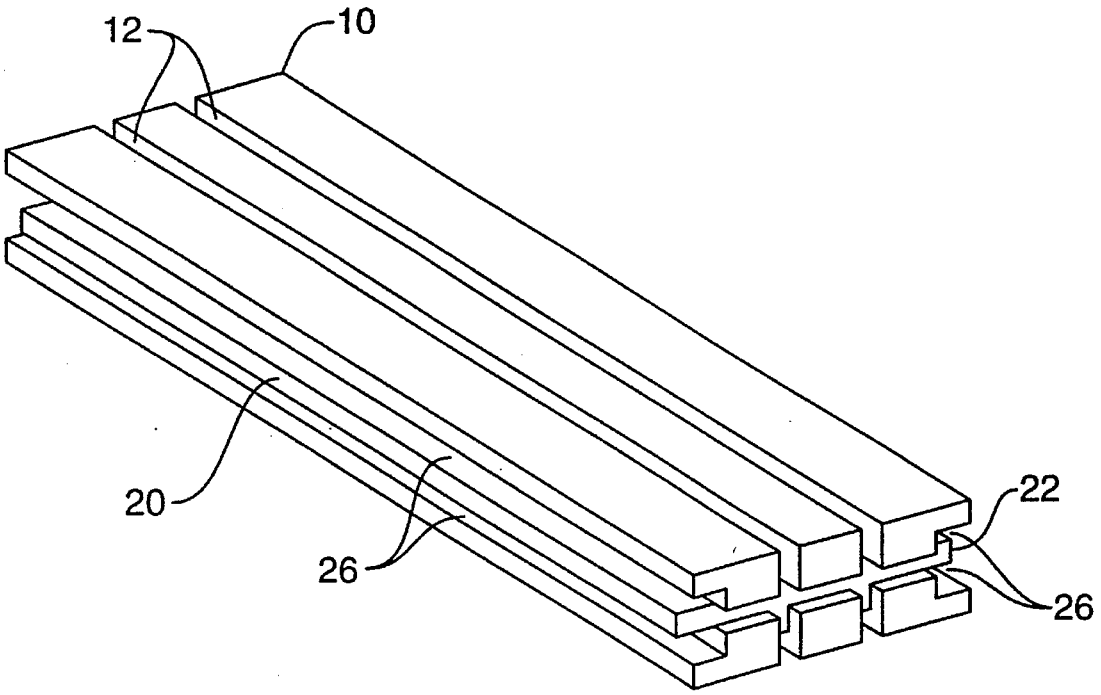
FIG. 3 is a perspective view of the pellet shown in FIG. 2 after additional grooves have been formed by milling the pellet.

After the pellet configuration shown in FIG. 3 is formed, the pellet 10 is coated with a conventional ignition composition through dip coating, spraying, or another method known to those of skill in the art. Finally, the pellet 10 is installed in a conventional decoy flare housing (not shown) and prepared for deployment aboard an aircraft in conventional fashion.

In summary, the conventional two-step process first produces a pellet 10 as shown in FIG. 2 and then mills additional grooves 26 in that pellet 10 to reach the configuration shown in FIG. 3. This conventional approach requires significant time and money to accomplish the milling and to properly dispose of the milled material. The milled material, which may account for approximately fifteen percent of the total flare material used, is wasted.

Figure 4:
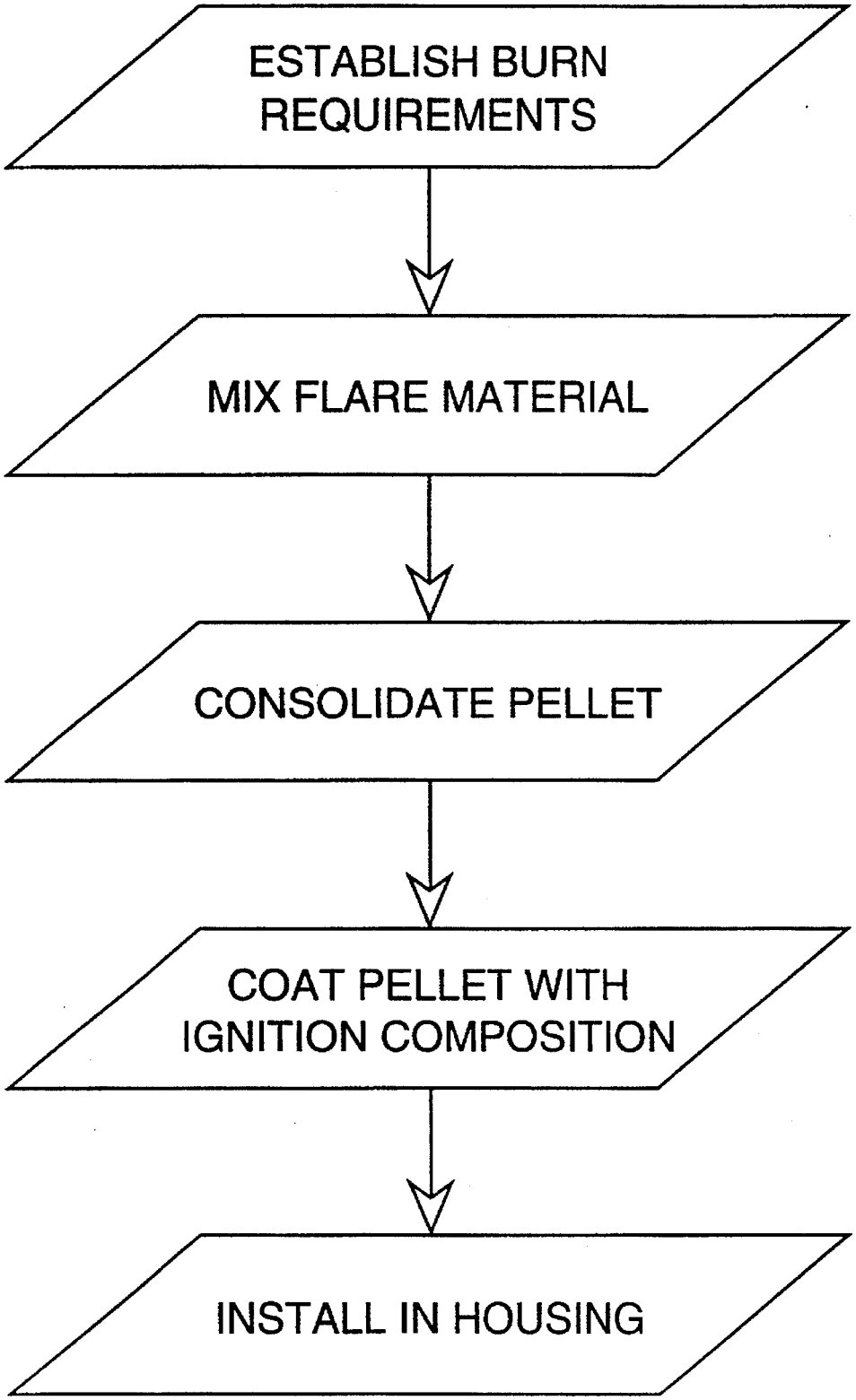
FIG. 4 is a flow diagram illustrating the present invention's elimination of the step of milling grooves into a pellet after consolidation.

The process of the present invention is illustrated in FIG. 4. The present invention completely eliminates the milling, cutting equipment maintenance, and waste disposal steps of the conventional process. The process of the present invention begins with the step of establishing burn requirements for the flare pellet. This may include obtaining data on the spectral characteristics and intensity over time of the simulated aircraft, as well as analyzing the interpretation of the targeted aircraft's engine emissions by the heat-seeking missile. The decoy must burn at an intensity and for a duration that will induce an enemy missile to lock onto the decoy instead of the targeted friendly aircraft. The decoy flare's emissions may also be specified in terms of wavelength signatures.

After the burn requirements are determined, an appropriate flare material and an appropriate ignition composition are mixed. The flare material may be composed of conventional binders, fuels, compounds to produce desired wavelengths (such as infrared) or intensities in the burning flare pellet's output, and other compositions known to those of skill in the art. For instance, the flare material may contain polytetrafluoroethylene (PTFE) as a binder. The flare material is capable of being formed into a pellet such as the pellet 30 in FIG. 5 through consolidation. The ignition composition may be familiar to those of skill in the art. The ignition composition ignites more easily than the flare material, and is capable of igniting the flare material after being ignited itself.

The consolidation step of FIG. 4 may be accomplished by preparing a die (not shown) having two faces, placing flare material on one die face, and compressing the flare material between the two die faces. When the perimeters of the die faces meet, the die defines a volume corresponding to a flare pellet. The die faces are constructed to provide the flare pellet with sufficient surface area to meet the burn requirements. In a presently preferred embodiment, compressing the flare material between the die faces causes PTFE in the flare material to flow and subsequently form a solid matrix with the other flare material components. The solid matrix helps the flare pellet retain its shape after being removed from the separated die faces.

After consolidation, the pellet is coated with the ignition composition. The pellet may be dip-coated, sprayed, or otherwise coated. As the consolidation step provides the pellet with sufficient area to meet the burn requirements, no milling step intervenes between consolidation and the application of a coat of ignition composition. Finally, the pellet is installed in a conventional decoy flare housing (not shown) and prepared for deployment aboard an aircraft in conventional fashion.

Figure 5:
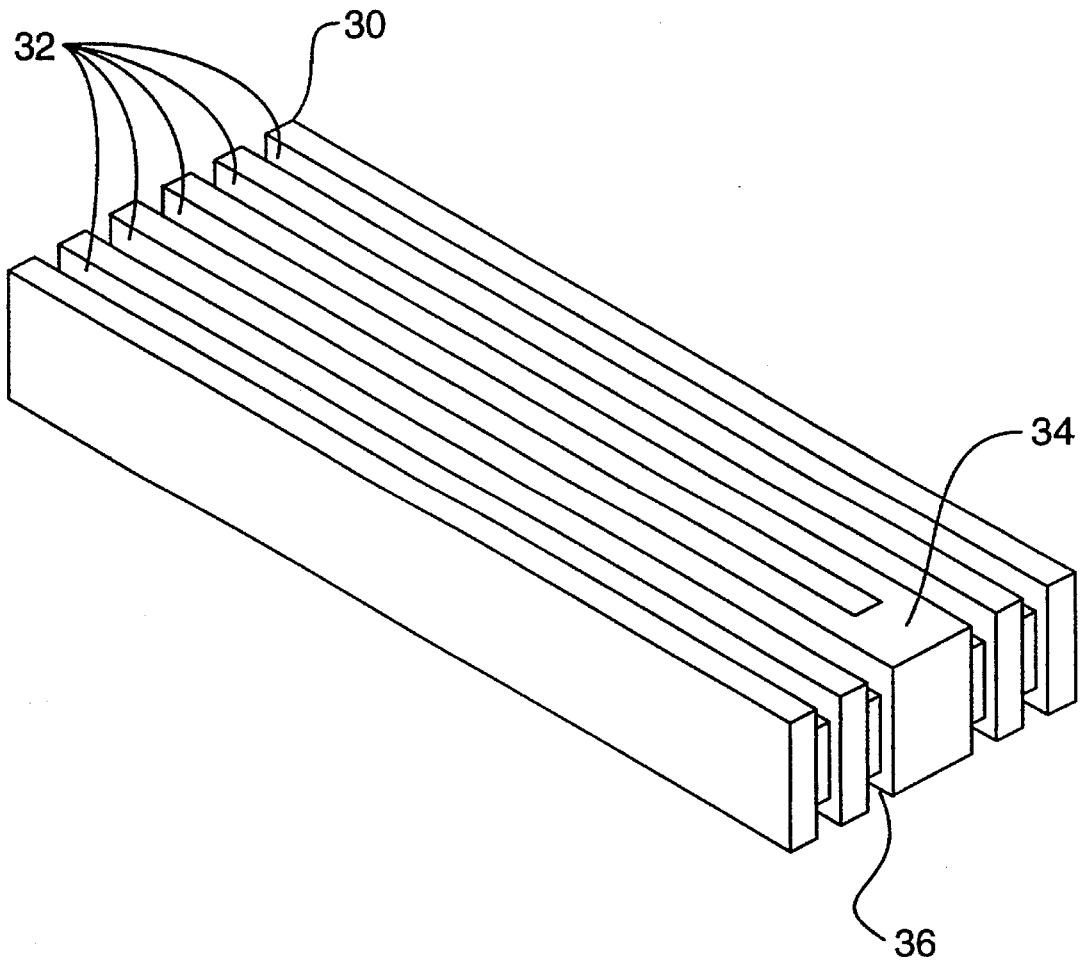
FIG. 5 is a perspective view of a pellet produced according to the present invention, illustrated in FIG. 4, in which the pellet contains grooves produced only by consolidation.

FIG. 5 illustrates a pellet 30 produced according to the present invention. All of the grooves 32 in the pellet 30 are produced during consolidation; none of the grooves 32 are milled. In order to satisfy the burn requirements, the ten grooves 32 provide substantially the same surface area as the eight grooves (12 and 26 in FIG. 3) utilized in pellets (10 in FIG. 3) formed according to the conventional approach.

Although the surface area of the pellet 30 is substantially the same as the surface area of a conventional pellet (10 in FIG. 3), the pellet 30 is asymmetrical. As illustrated in FIG. 3, it has previously been thought in the art of flare design that grooves should be placed symmetrically about the longitudinal axis 24 of a pellet 10 to obtain satisfactory performance. However, using the present invention such symmetry is not necessary. Experimentation with the position, shape, and depth of the grooves 32 allows optimization of the burning surface profile and, therefore, optimization of the energy output of the flare pellet 30. Although the configuration of grooves 32 shown in FIG. 5 is presently preferred, it will be appreciated that other groove configurations formed without substantial milling while satisfying the burn requirements also lie within the scope of the present invention.

Although decoy flare pellets are described above, the scope of the present invention includes explosives, propellants, illuminants, pyrotechnics, and other items produced by a process from which milling can be reduced or eliminated through a proper consolidation step. The present invention also includes processes for producing such products.

Experimental Results conventional pellets and pellets made according to the present invention have been created for testing purposes and subjected to static burn tests. The results of the tests of conventional pellets are summarized in FIG. 6, while the test results for pellets of the present invention are summarized in FIG. 7.

Initially, the conventional test pellets were solid blocks of flare material containing no grooves after consolidation. Each of six such pellets 10 was cut with four grooves 0.20 inches deep (12 in FIG. 3) and four grooves 0.20 inches deep (26 in FIG. 3). The resulting pellets were coated, taped, and prepared for static testing according to normal procedures.

Figure 6:
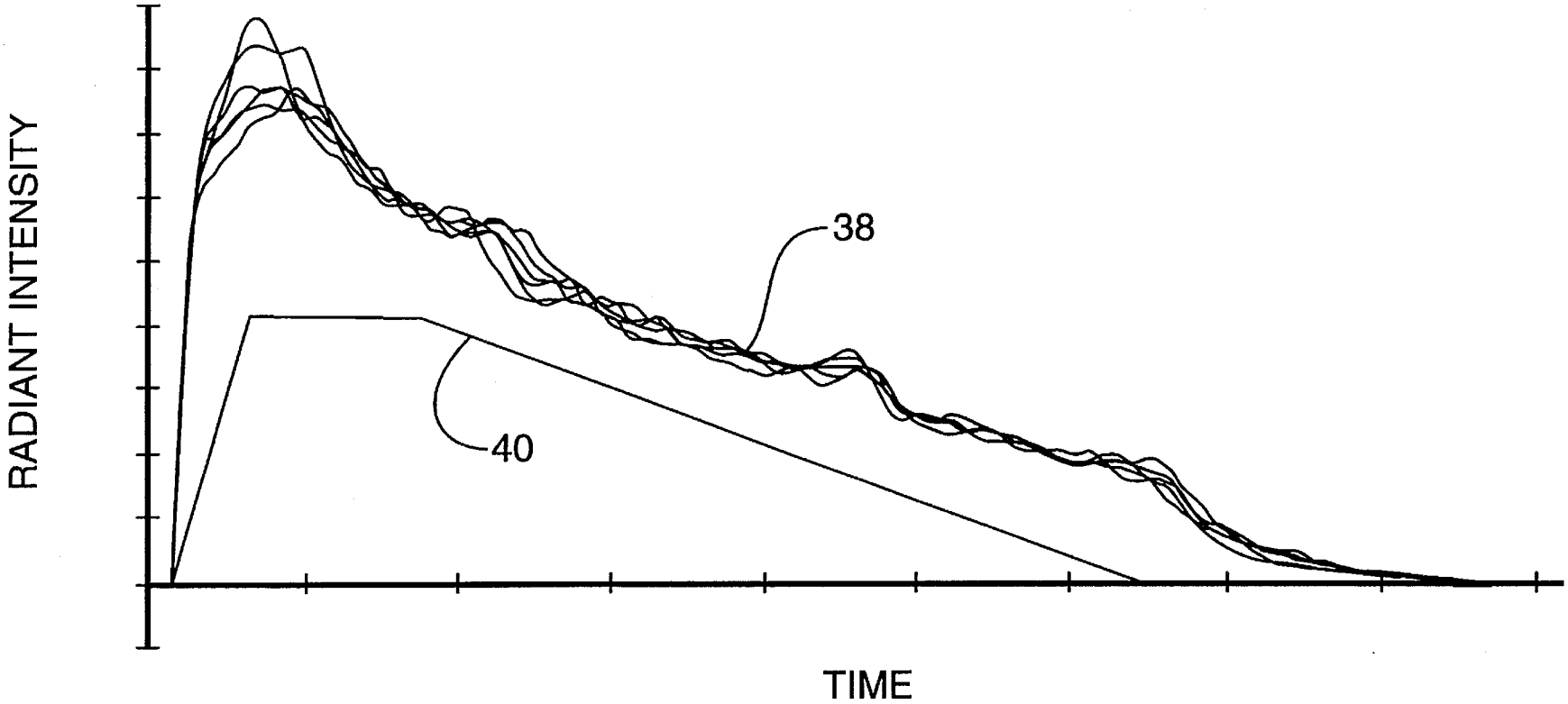
FIG. 6 is a graph illustrating the intensity over time of the output of six conventional test flare pellets, and also illustrating the burn output requirement.

As illustrated in FIG. 6, all six pellets satisfied the intensity and duration burn output requirements. The six traces 38 represent the intensity of the conventional pellets as a function of time. The function 40 represents the predetermined burn requirements. As the six traces 38 are above the function 40, the static burn requirements were satisfied.

Figure 7:
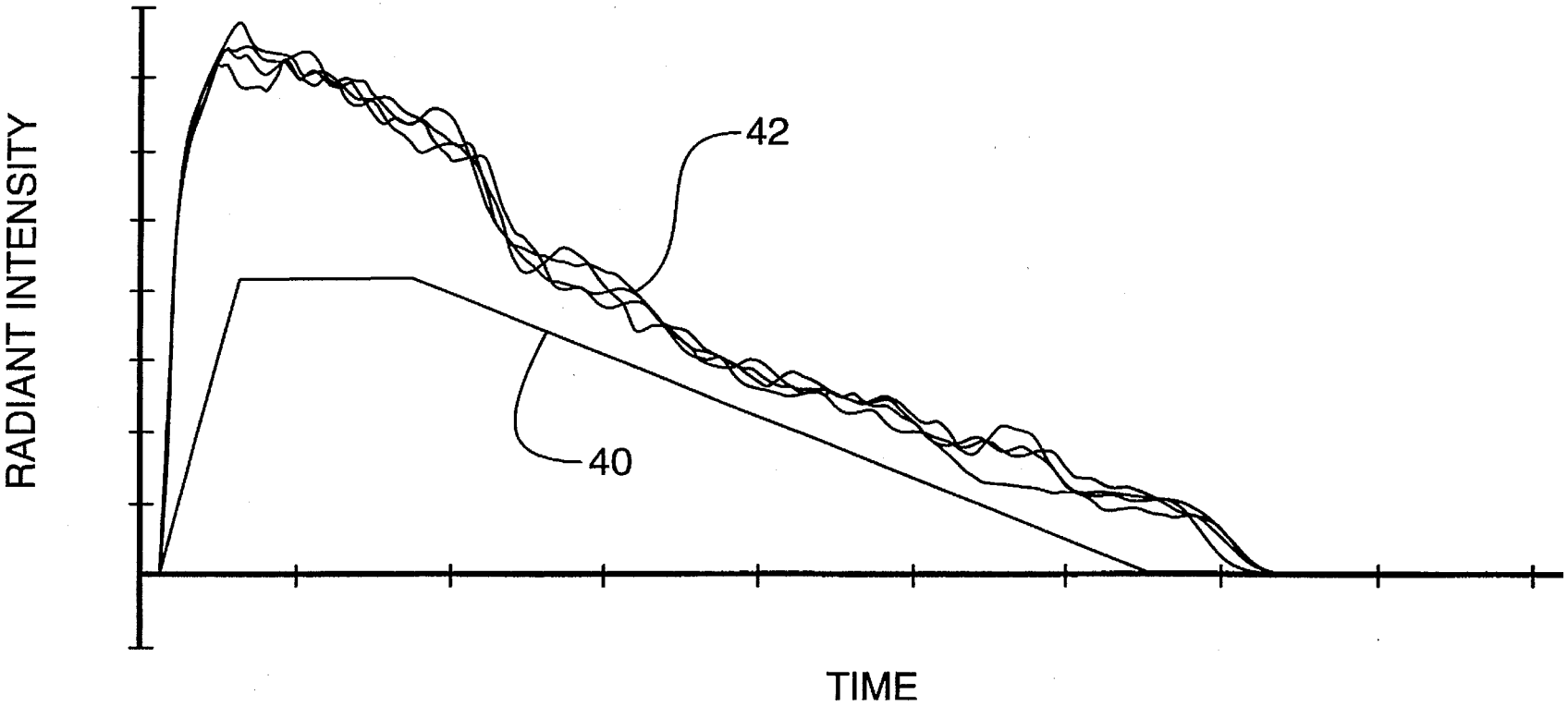
FIG. 7 is a graph illustrating the intensity over time of four test flare pellets configured according to the teachings of the present invention, and also illustrating the burn output requirement.

FIG. 7 illustrates the test results for four pellets formed to test the present invention. Initially, the four test pellets were solid blocks of flare material containing no grooves after consolidation. All grooves were cut to test the concept of the present invention. Each of the four pellets were cut with ten grooves 0.20 inches deep (32 in FIG. 5). The resulting pellets were coated, taped, and prepared for static testing according to normal procedures. As the traces 42 of the test pellets are above the function 40, the static burn requirements were met by all of the pellets.

Based on these results, a die was fabricated to produce a pellet such as the pellet 30 of FIG. 5 without milling. The die (not shown) included dual punches forming the grooves 32 on the top 34 and bottom 36 of the pellet 30 simultaneously. The die was used to form several pellets 30 to test different finishing methods. By dip coating the pellets 30 with ignition composition, the pellets 30 were finished with fewer operations and at lower cost. Static testing confirmed the previous positive test results.

In summary, the advantageous nature of the present invention arose from the insight that asymmetric groove configurations do not necessarily prevent satisfactory performance. The position, shape, and depth of the grooves can be optimized by those of skill in the art without undue experimentation. By properly modifying the consolidation step, the milling step may be eliminated. Proper modification includes providing additional grooves on the pellet's top and bottom and eliminating the step of milling grooves into the pellet's sides while substantially maintaining the pellet's surface area.

Thus, the present invention permits the effective and efficient production of decoy flare pellets. In sharp contrast with conventional approaches, the present invention eliminates the need for expensive and wasteful milling operations to produce additional surface pellet area after consolidation. The resulting reductions in material, labor, equipment, and disposal costs may be substantial.

What is claimed and desired to be secured by patent is:

1. A process for forming a flare pellet comprising the steps of:

determining the burn requirements of the flare pellet;

formulating a quantity of flare material;

preparing a die having a first die face and a second die face;

placing the flare material adjacent the first die face; and compressing the flare material between the first die face and the second die face to provide the compressed material with sufficient surface area to satisfy the burn requirements.

2. The process of claim 1, wherein said step of compressing the flare material includes the step of creating substantially parallel grooves in the compressed material adjacent the first die face and also creating substantially parallel grooves in the compressed material adjacent the second die face.

3. The process of claim 1, further comprising the steps of:

removing the compressed material from between the die faces; and coating the surface of the compressed material with an ignition composition.

4. The process of claim 3, wherein said step of coating the surface of the compressed material includes dip-coating the compressed material by immersing the compressed material in a fluid ignition composition.

5. The process of claim 1, wherein the predetermined burn requirements include production of infrared emissions.

6. The process of claim 5, wherein the step of formulating flare material includes selecting a flare material that produces infrared emissions when burned.

7. A process for forming a flare pellet from flare material, comprising the steps of:

determining the burn requirements the flare pellet must satisfy;

formulating a quantity of flare material containing polytetrafluoroethylene;

preparing a die having a first die face and a second die face;

placing the flare material adjacent the first die face; and consolidating the flare material by compressing the flare material between the first die face and the second die face, thereby providing the consolidated material with sufficient surface area to satisfy the burn requirements.

8. The process of claim 7, wherein said step of compressing the flare material includes the step of creating substantially parallel grooves in the flare material.

* * * * *